US005393571A

United States Patent [19]

Suga et al.

[11] Patent Number: 5,393,571

[45] Date of Patent: Feb. 28, 1995

[54] CURTAIN COATING METHOD FOR ELIMINATING SAGGING AT HIGH FLOW RATES

[75] Inventors: Yasushi Suga; Kenji Nakajima; Kiyoshi Kobayashi; Kimiaki Miyamoto, all of Kanagawa, Japan

[73] Assignee: Fuji Photo Film Co., Ltd., Kanagawa, Japan

[21] Appl. No.: 3,686

[22] Filed: Jan. 13, 1993

Related U.S. Application Data

[63] Continuation of Ser. No. 605,304, Oct. 30, 1990, abandoned.

[30] Foreign Application Priority Data

Oct. 31, 1989 [JP] Japan ..... 1-282030

[51] Int. Cl.[6] ..... B05D 1/30

[52] U.S. Cl. ..... 427/420; 118/DIG. 4

[58] Field of Search ..... 427/420; 118/DIG. 4

[56] References Cited

U.S. PATENT DOCUMENTS

| | | | |
|---|---|---|---|
| 3,022,172 | 2/1962 | Ohba et al. . | |
| 3,508,947 | 4/1970 | Hughes | 117/34 |
| 3,632,374 | 1/1972 | Greiller | 117/34 |
| 3,655,407 | 4/1972 | McGraw | 96/114 |
| 3,705,798 | 12/1972 | Kleim et al. | 96/3 |
| 3,811,897 | 5/1974 | Babbit et al. | 96/114 |
| 4,041,897 | 8/1977 | Ade | 118/300 |
| 4,233,346 | 11/1980 | Kerkhofs | 427/420 |
| 4,510,882 | 4/1985 | Prato | 427/420 |
| 4,569,863 | 2/1986 | Koepke et al. | 427/402 |
| 4,842,900 | 6/1989 | Miyamoto | 427/348 |
| 4,922,851 | 5/1990 | Morikawa et al. | 118/324 |

FOREIGN PATENT DOCUMENTS

| | | |
|---|---|---|
| 376325 | 7/1990 | European Pat. Off. . |
| 49-115311 | 11/1974 | Japan . |
| 51-81123 | 7/1976 | Japan . |
| 52-67318 | 6/1977 | Japan . |
| 53-39118 | 4/1978 | Japan . |
| 53-39119 | 4/1978 | Japan . |
| 57-105471 | 6/1982 | Japan . |
| 61-203451 | 9/1986 | Japan . |
| 62-197176 | 8/1987 | Japan . |
| 64-51170 | 2/1989 | Japan . |
| 1131549 | 5/1989 | Japan . |
| 676459 | 7/1952 | United Kingdom . |
| 1539866 | 4/1979 | United Kingdom . |

OTHER PUBLICATIONS

Article from Symposium Aiche Winter National Meeting 1982, *Fundamentals of Coating Operations–I.* (no month date).

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A coating method that is capable of rapid curtain coating without causing "sagging" at high flow rates exceeding 4 $cm^3/cm.sec$. One or more layers of a coating solution are formed on a sliding surface, and a free falling curtain of the coating solution is allowed to impinge against a continuously running web. The web has a surface roughness of at least 0.3 μm, the tip of the sliding surface forms an angle of 45° to 120° with respect to the horizontal, and the viscosity of the coating solution is adjusted to at least 90 cps for low shear rate, with the average for all layers formed being at least 80 cps.

16 Claims, 1 Drawing Sheet

CURTAIN COATING METHOD FOR ELIMINATING SAGGING AT HIGH FLOW RATES

This is a continuation of application No. 07/605,304, filed Oct. 30, 1990, now abandoned.

BACKGROUND OF THE INVENTION

The present invention relates to a method by which various liquid compositions are curtain-coated onto a continuously running support in strip form (which is hereinafter referred to as a "web") in the manufacture of photographic films, photographic papers, magnetic recording tapes, adhesive tapes, pressure-sensitive recording papers, offset printing plates, etc.

The basic technology of curtain coating is described in U.S. Pat. Nos. 3,508,947 and 3,632,374. In "AIChE Winter National Meeting" (1982), S. F. Kistler disclosed the theory of curtain coating, focusing on the following three phenomena which he considered would govern the rate of application by curtain coating:

(1) incorporation of tiny air bubbles between the web and the coating solution (which phenomenon is hereinafter referred to as "air entrainment");

(2) formation of a liquid deposit along the line where the coating solution contacts the web (which phenomenon, hereinafter referred to as "heel", is common with large coating weights); and (3) the coating solution is not adequately deposited but will bounce off the web being coated (which phenomenon, hereinafter referred to as "sagging", is caused by "heel with air entrainment" and is also common with large coating weights ).

According to Kistler, curtain coating is no longer possible if one or more of these phenomena occur.

Various attempts have been made to increase the curtain coating speed limited by the aforementioned phenomena. They include:

(1) replacing the web-entrained air layer with carbon dioxide to suppress the phenomenon of "air entrainment" (see U.S. Pat. No. 4,842,900);

(2) applying a static electric field between the web and the coating solution, whereby the adhesion of the latter is enhanced to suppress the phenomenon of "air entrainment" (see Unexamined Published Japanese Patent Application No. 197176/1987); and (3) stabilizing the deposition of the free falling curtain on the web by specifying the shape of the tip of the sliding surface and the angle at which the free falling curtain is deposited on the web (see Unexamined Published Japanese Patent Application No. 51170/1989).

In fact, however, as modern coating plants adopt application speeds of 250 m/min and higher with the curtain of coating solution flowing down in higher rates, the limitation of coating speeds by "heel" and "sagging" has become a greater concern than the limitation by "air entrainment". A method that has been proposed for dealing with this problem is:

(4) suppressing the phenomenon of "heel" by properly adjusting the viscosity between the lower and upper layers of coating solution (see Unexamined Published Japanese Patent Application No. 131549/1989).

The techniques described in Unexamined Published Japanese Patent Application Nos. 51170/1989 and 131549/1989 are such that the flow rate of coating solution is in the range of 1.0–4.0 $cm^3$/cm.sec (the unit length of the coating width being expressed in centimeters). These techniques are effective at flow rates within the specified range, but no study has been conducted to determine whether they are effective in suppressing the phenomenon of "sagging" in flow quantities exceeding 4 $cm^3$/cm.sec.

SUMMARY OF THE INVENTION

An object, therefore, of the present invention is to solve the aforementioned problems of the prior art by providing a coating method that is capable of rapid curtain coating without causing "sagging" at high flow quantities exceeding 4 $cm^3$/cm.sec.

The aforementioned and other objects of the present invention have been attained by a coating method comprising the steps of forming one or more layers of a coating solution on a sliding surface and allowing a free falling curtain of the coating solution to impinge against a continuously running web, in which method the web has a surface roughness of at least 0.3 μm, the tip of the sliding surface forms an angle of 45° to 120° with respect to the horizontal, and the viscosity of the coating solution is adjusted to at least 90 cps for low shear rate, with the average for all layers formed being at least 80 cps.

DESCRIPTION OF THE PREFERRED EMBODIMENTS

Figure 1:
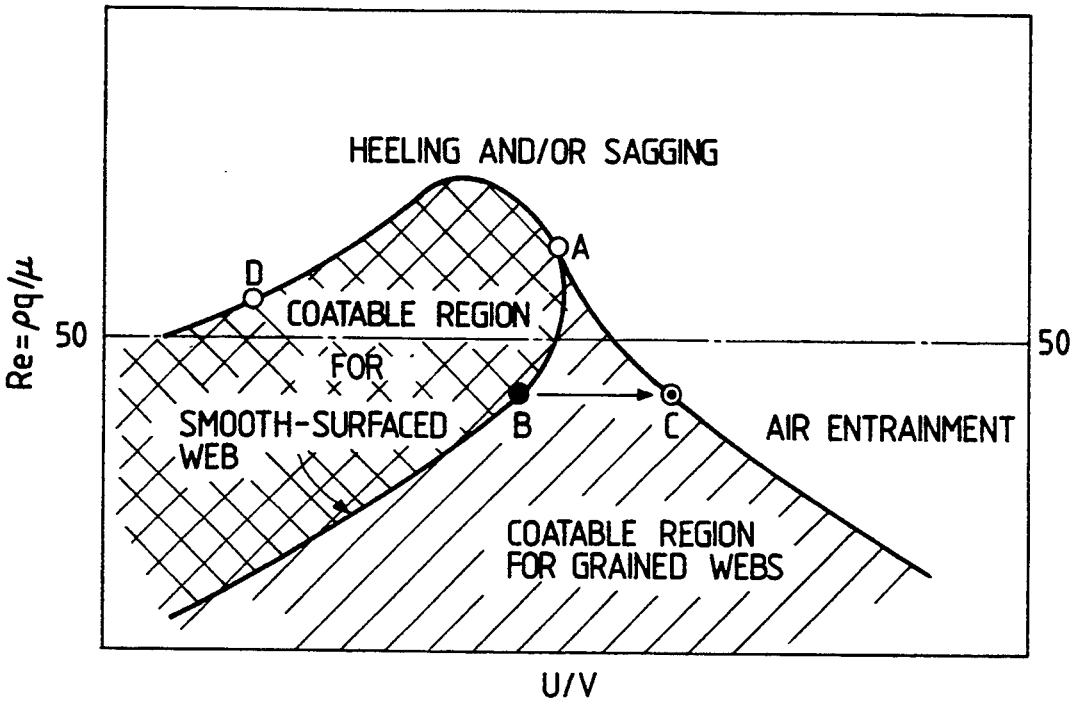
FIG. 1 is a diagram showing the relationship between Reynolds number Re and U/V as observed in the practice of a conventional curtain coating by the method.

Various webs can be used in the present invention and they include paper, plastic films, resin-coated paper and synthetic paper. Plastic films may be made of the following materials: polyolefins such as polyethylene and polypropylene; vinyl polymers such as polyvinyl acetate, polyvinyl chloride and polystyrene; polyamides such as 6,6-nylon and 6-nylon; polyesters such as polyethylene terephthalate and polyethylene-2,6-naphthalate; polycarbonates; and cellulose acetates such as cellulose monoacetate, cellulose diacetate and cellulose triacetate. Resins to form resin-coated paper may be exemplified by, but not limited to, polyolefins such as polyethylene.

The web having a surface roughness of at least 0.3 μm which is to be used in the present invention may be exemplified by those webs to be used in producing photographic papers which have a glossy surface, matted surface, silky surface, etc. A common example of such webs is raw paper that is laminated with polyethylene on both sides and which may be compressed with embossed rollers to attain a surface roughness in the range of from 0.3 μm to about 30 μm, depending on the specific use of the product.

As in the case of photographic film supports made of such materials as triacetate cellulose and polyethylene terephthalate, the web to be used in the present invention may be coated with a subbing solution having fine inorganic particles (e.g., $SiO_2$ and $Al_2O_3$) or fine polymeric particles (e.g., polystyrene and polymethylmethacrylate) dispersed therein. Alternatively, as in the case of offset printing plates, the web may be an aluminum plate whose surface is rendered grainy by sand blasting, electrolytic pitting or some other means.

The coating solution to be used in the present invention may have various compositions depending upon its specific use. To mention a few examples, the following coating solutions may be used: a coating solution for preparing photographic materials comprising light-sensitive emulsion layers, a subbing layer, a protective layer, a backing layer, etc.; a coating solution for preparing magnetic recording media comprising a magnetic layer, a subbing layer, a lubricating layer, a protective layer, a backing layer, etc.; and a coating solution comprising an adhesive layer, a colored layer, a corrosion-resistant layer, etc. These coating solutions contain a water-soluble binder or an organic binder.

The term "viscosity of the coating solution for low shear rate" as used herein means the value of viscosity measured at a shear rate of 10 $sec^{-1}$. Viscosity measurements can be performed using thickeners that interact with the binder in the coating solution in an electrostatic manner by, for example, ionic bonding or hydrogen bonding. This method is effective in increasing the viscosity of the coating solution at low shear rate without substantially increasing its viscosity at high shear rate.

If the binder in the coating solution is gelatine as in the case of ordinary silver halide light-sensitive materials, anionic polymers such as poly(potassium styrenesulfonate) may be used as a thickener. More specific examples are described in Unexamined Published Japanese Patent Applications Nos. 115311/1974, 81123/1976, 67318/1977, 39118/1978, 39119/1978, 105471/1982, 203451/1986, British Patent Nos. 676,459, 1,539,866, and U.S. Pat. Nos. 3,022,172, 3,655,407, 3,705,798 and 3,811,897.

The limitation on the application speeds that can be achieved in curtain coating is described below with reference to FIG. 1, which is a coating operation map for the practice of curtain coating by the method proposed by Kistler. The Reynolds number (Re) ($Re=\rho q/\mu$, where $\rho$ is the density of the coating solution, q is the flow rate of the coating solution per unit length of coating width, and $\mu$ is the viscosity of the coating solution at low shear rate) as a function of U/V (where U is the web transport speed (coating speed) in m/sec and V is the linear speed (m/sec) of the falling coating solution to be deposited on the web) can be read from FIG. 1.

As FIG. 1 shows, the area bounded by curve D-A-B is where coating can be done on a smooth-surfaced web. If the coating solution is excessively viscous, the value of $Re=\rho q/\mu$ decreases to cause a shift to the area under curve A-B where coating is impossible due to "air entrainment". In the area above curve D-A-B, the viscosity of the coating solution is so low that coating is impossible due to "heeling" or "sagging".

In the case of a grained web which has a surface roughness of at least 0.3 $\mu$m, a shift occurs from curve D-A-B to curve A-C which, as FIG. 1 shows, has the area of "coating possible" extending further downward compared to curve D-A-B. In other words, when the viscosity of the coating solution is increased, the value of Re decreases, causing the limit coating speed corresponding to the lower Re value to increase from point B (indicted by the solid dot in FIG. 1) to point C (indicated by the double circle). The increase in the coating speed due to the decrease in the value of Re is particularly marked when the average viscosity of the coating solution for all the layers formed is no less than 80 cps at low shear rate. The average viscosity of the coating solution for all layers formed is obtained by averaging the viscosities of the individual layers after weighting with the proportions of the flow rates of the associated coating solutions. The above-described advantage of the present invention is attained most efficiently when the viscosity of the lowermost layer simultaneously has a viscosity of at least 90 cps.

Also important for the purpose of applying coating solutions in the range of high flow rates that are contemplated by the present invention is the direction in which the coating solution falls down the tip of the sliding surface to form a free falling curtain. The above-described advantage of the present invention is attained when the angle which the tip of the sliding surface makes with the horizontal is in the range of 45° to 120°.

EXAMPLE

The following example is provided for the purpose of further describing the coating method of the present invention, but should in no way be taken as limiting.

A sodium salt of 2-ethylhexyl $\alpha$-sulfosuccinate was added as a surfactant in an amount of 1.5 g/l to an aqueous solution containing 10 wt % alkali-processed gelatin. Poly(sodium styrenesulfonate) having a molecular weight of about 1,000,000 was added as a thickener in various amounts to prepare samples of coating solution having different viscosities. A red dye was added to stain each coating solution. Using a slide hopper type curtain coater capable of simultaneous application of two layers that had the construction shown in FIG. 2, the stained coating solutions 3 were coated onto a web 1 on a coating roller 4 through a coating die 2 in flow rates of 4–6 $cm^3$/cm.sec, with the height of the curtain (i.e., distance from the tip of the coating die to the highest point of the coating roller) being maintained at 100 mm. The data on the limit coating speed (m/min), i.e., the speed beyond which sagging occurred, in relation to the viscosity of the coating solution (cps) is given in Table 1.

Figure 2:
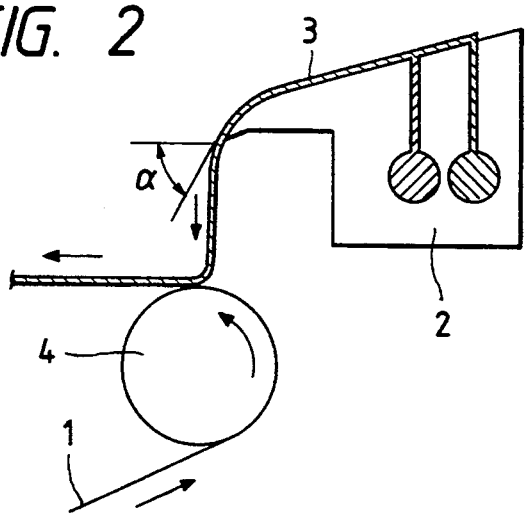
FIG. 2 is a schematic side view of a curtain coater which may be used in practicing the invention.

The above-noted angle made by the tip of the sliding surface with respect to the horizontal is denoted by $\alpha$ in FIG. 2. One side of the angle is formed by a line tangent to the sliding surface of the coating die 2 at its edge where the coating solution departs from the coating die 2. The other side of the angle is formed by a horizontal line intersecting the first-mentioned line at the edge of the coating die 2.

TABLE 1

| Run No. | Viscosity averaged for all layers (cps) | Viscosity of lowermost layer (cps) | Angle of tip of sliding surface (deg) | Flow quantity, ($cm^3$/cm · sec) | Limit coating speed (m/min) |
|---|---|---|---|---|---|
| Comparison | | | | | |
| 1 | 25 | 25 | 45 | 4 | 210 |
| 2 | 30 | 30 | 45 | 5 | 280 |
| 3 | 55 | 55 | 45 | 4 | 290 |
| 4 | 103 | 25 | 45 | 4 | 230 |
| 5 | 60 | 60 | 120 | 6 | 290 |
| Invention | | | | | |
| 6 | 100 | 100 | 90 | 5 | 380 |
| 7 | 120 | 120 | 45 | 4 | 435 |
| 8 | 180 | 180 | 45 | 6 | 460 |
| 9 | 90 | 90 | 75 | 4 | 350 |

TABLE 1-continued

| Run No. | Viscosity averaged for all layers (cps) | Viscosity of lowermost layer (cps) | Angle of tip of sliding surface (deg) | Flow quantity, ($cm^3$/cm · sec) | Limit coating speed (m/min) |
|---|---|---|---|---|---|
| 10 | 135 | 135 | 120 | 5 | 440 |

All viscosity values are those at low shear rate (10 $sec^{-1}$). The "viscosity averaged for all layers" is the result of weighting with the proportions of the flow rates of the individual layers. The coating solution for the lowermost layer was allowed to flow in a quantity that was 20% of the total flow.

The web to be coated was resin-coated (polyethylene laminated) paper having a gelatine subbing layer and a surface roughness of 0.4 82 m.

As Table 1 shows, the limit coating speed could be appreciably enhanced by insuring that the average viscosity for all layers is at least 80 cps. Even with high average values, the limit coating speed will sometimes decreases if the viscosity of the lowermost layer is low.

As additional comparative samples, a triacetate cellulose film having a surface roughness of no more than 0.1 μm was subbed with a copolymer of styrene and a sodium salt of maleic anhydride, and further coated with the same coating solutions as used above. The results are shown in Table 2, from which one can see that the viscosity adjustment was not at all effective when webs of low surface roughness were employed.

TABLE 2

| Run No. (Comparison) | Viscosity averaged for all layers (cps) | Viscosity of lowermost layer (cps) | Angle of the tip of sliding surface (deg) | Flow quantity ($cm^{-3}$/cm · sec) | Limit coating speed ($m/min^{-1}$) |
|---|---|---|---|---|---|
| 11 | 100 | 100 | 90 | 5 | 325 |
| 12 | 140 | 140 | 120 | 5 | 305 |
| 13 | 60 | 60 | 45 | 5 | 310 |

The coating method of the present invention enables high-speed curtain coating operations to be performed at flow rates exceeding 4 $cm^3$/cm.sec without causing the phenomenon of "sagging", which contributes to a marked improvement in productivity.

What is claimed is:

1. A curtain coating method comprising the steps of forming one or more layers of a coating solution on a sliding surface and allowing a free falling curtain of the solution to impinge against a continuously running web, wherein the web has a surface roughness of at least 0.3 μm, a tip of the sliding surface forms an angle in a range of 45° to 120° with respect to the horizontal, a flow quantity of the coating solution is at least 4 $cm^3$/cm.sec, a viscosity of the coating solution is adjusted to at least 90 cps for low shear rate, with an average viscosity for all layers formed being at least 80 cps, and the web is continuously run at a speed exceeding 325 m/min.

2. A curtain coating method comprising the steps of forming one or more layers of a coating solution on a sliding surface and allowing a free falling curtain of the solution to impinge against a continuously running web, wherein the web has a surface roughness of at least 0.3 μm, a tip of the sliding surface forms an angle in a range of 45° to 120° with respect to the horizontal, a flow quantity of the coating solution is at least 4 $cm^3$/cm.sec, a viscosity of the coating solution is adjusted to at least 90 cps for low shear rate, with an average viscosity for all layers formed being at least 80 cps, and a coating speed for the method exceeds 325 m/min.

3. The coating method of claim 2, wherein the web is made of a material selected from the group consisting of paper, plastic films, resin-coated paper and synthetic paper.

4. The coating method of claim 2, wherein the web comprises a plastic film made of a material selected from the group consisting of: polyolefins inclusive of polyethylene and polypropylene; vinyl polymers inclusive of polyvinyl acetate, polyvinyl chloride and polystyrene; polyamides inclusive of 6,6-nylon and 6-nylon; polyesters inclusive of polyethylene terephthalate and polyethylene-2,6-naphthalate; polycarbonates; and cellulose acetates inclusive of cellulose monoacetate, cellulose diacetate and cellulose triacetate.

5. The coating method of claim 2, wherein the web is made of a resin-coated paper.

6. The coating method of claim 5, wherein the resin-coated paper is coated with a polyolefin.

7. The coating method of claim 6, wherein the polyolefin is polyethylene.

8. The coating method of claim 2, wherein the web is made of raw paper laminated with polyethylene on both sides.

9. The coating method of claim 8, wherein the paper is compressed with embossed rollers to attain a surface roughness in the range of from 0.3 μm to 30 μm.

10. The coating method of claim 2, wherein the web is coated with a subbing solution having fine inorganic particles dispersed therein.

11. The coating method of claim 10, wherein the inorganic particles are made from a material selected from the group consisting of $SiO_2$ and $Al_2O_3$.

12. The coating method of claim 9, wherein the web is coated with a subbing solution having fine polymeric particles dispersed therein.

13. The coating method of claim 12, wherein the polymeric particles are made from a material selected from the group consisting of polystyrene and polymethylmethacrylate.

14. The coating method of claim 2, wherein the web is an aluminum plate having a grainy surface.

15. The coating method of claim 2, wherein the coating solution is a solution selected from the group consisting of: a coating solution for preparing photographic materials comprising light-sensitive emulsion layers, a subbing layer, a protective layer, and a backing layer; a coating solution for preparing magnetic recording media comprising a magnetic layer, a subbing layer, a lubricating layer, a protective layer, and a backing layer; and a coating solution comprising an adhesive layer, a colored layer, and a corrosion-resistant layer.

16. The coating method of claim 15, wherein the coating solution contains a water-soluble binder or an organic binder.

* * * * *